US011514829B2

(12) United States Patent
Ishii

(10) Patent No.: US 11,514,829 B2
(45) Date of Patent: Nov. 29, 2022

(54) DISPLAY DEVICE AND SOURCE DRIVER

(71) Applicant: LAPIS Semiconductor Co., Ltd., Yokohama (JP)

(72) Inventor: Hiroaki Ishii, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

(21) Appl. No.: 17/170,795

(22) Filed: Feb. 8, 2021

(65) Prior Publication Data

US 2021/0272489 A1 Sep. 2, 2021

(30) Foreign Application Priority Data

Feb. 27, 2020 (JP) ..... JP2020-031696

(51) Int. Cl.
*G09G 3/00* (2006.01)
*G09G 3/20* (2006.01)
*G09G 3/30* (2006.01)

(52) U.S. Cl.
CPC ..... *G09G 3/006* (2013.01); *G09G 3/2003* (2013.01); *G09G 3/30* (2013.01); *G09G 2310/0243* (2013.01); *G09G 2310/08* (2013.01)

(58) Field of Classification Search
CPC ..... G09G 3/006; G09G 3/2003; G09G 3/30; G09G 2310/0243; G09G 2310/08; G09G 3/3688; G09G 2330/12; G09G 2370/08; G09G 3/3275
See application file for complete search history.

(56) References Cited

U.S. PATENT DOCUMENTS

2018/0210774 A1* 7/2018 Young ..... G06F 11/0769
2019/0392742 A1* 12/2019 Muraki ..... G09G 3/20

FOREIGN PATENT DOCUMENTS

JP 2018136371 8/2018

* cited by examiner

*Primary Examiner* — Mark W Regn
(74) *Attorney, Agent, or Firm* — JCIPRNET

(57) ABSTRACT

A display device includes a display panel, a display controller configured to output a video data signal, a gate driver, and a plurality of source drivers which are arranged in an extension direction of gate lines and generate a gradation voltage signal to be supplied to each of a plurality of pixel units based on the video data signal supplied from the display controller. Each of the plurality of source drivers includes a data processing unit configured to share an abnormal state sharing signal indicating whether an abnormality has occurred in communication with the display controller with other source drivers, and when the abnormal state sharing signal indicates that an abnormality has occurred in communication with the display controller, supply a gradation voltage signal corresponding to predetermined gradation data different from a gradation voltage signal based on the video data signal to each of the plurality of pixel units.

12 Claims, 10 Drawing Sheets

| Line \ Pixel | 1-801 | 802-804 | 805-807 | 808-810 | 811-813 | 814-816 | 817-819 | 820-960 |
|---|---|---|---|---|---|---|---|---|
| GL 1~999 | 0 | 0 | 0 | 0 | 0 | 0 | 0 | 0 |
| GL 1000 | 0 | 255 | 0 | 0 | 0 | 255 | 0 | 0 |
| GL 1001 | 0 | 0 | 255 | 0 | 255 | 0 | 0 | 0 |
| GL 1002 | 0 | 0 | 0 | 255 | 0 | 0 | 0 | 0 |
| GL 1003 | 0 | 0 | 255 | 0 | 255 | 0 | 0 | 0 |
| GL 1004 | 0 | 255 | 0 | 0 | 0 | 255 | 0 | 0 |
| GL 1005~1080 | 0 | 0 | 0 | 0 | 0 | 0 | 0 | 0 |

FIG. 5

DISPLAY DEVICE AND SOURCE DRIVER

CROSS-REFERENCE TO RELATED APPLICATION

This application claims the benefit of Japan Application No. 2020-031696, filed on Feb. 27, 2020. The entirety of the above-mentioned patent application is hereby incorporated by reference herein and made a part of this specification.

BACKGROUND

Technical Field

The disclosure relates to a display device and a source driver.

Description of Related Art

An active matrix drive type is used as a drive type for a display device such as a liquid crystal display device and an organic electro luminescence (EL). In an active matrix drive type display device, a display panel is composed of a semiconductor substrate in which pixel units and pixel switches are arranged in a matrix. The display is performed by controlling on and off the pixel switches by a gate pulse, and when the pixel switches are turned on, supplying a gradation voltage signal corresponding to a video data signal to the pixel units, and thus the brightness of the pixel units is controlled. A drive circuit of a display device includes, for example, a gate driver that outputs a gate pulse to a gate line, a source driver that outputs a gradation voltage signal to a data line, and a timing controller that supplies image data and a timing signal to the source driver.

The timing controller is connected to a driver IC of the source driver via a peer to peer (P2P) interface and transmits image data to the source driver. In this case, a communication error can occur and an error can occur in the image data. Therefore, a display system that detects an error in image data and detects a signal abnormality and a connection abnormality in the source driver on the reception side has been proposed (for example, Japanese Patent Laid-Open No. 2018-136371 (Patent Document 1)).

In addition, in small display devices used for in-vehicle electronic mirrors and the like, a configuration in which the gate driver is not controlled by the timing controller but is controlled by the source driver positioned close to the gate driver in order to shorten the length of the signal line is used. In such a display device, when there is a problem in communication between the timing controller and the source driver, the source driver intentionally stops a control signal of the gate driver and creates a state in which an output of the source driver is not applied to all pixels on the panel, and thus it is possible to prevent display distortion from occurring.

In the display system of the related art, the source driver that has detected an error in image data outputs the detection result to an external device such as a display controller or an electronic control unit (ECU). The external device performs processing according to error detection such as retransmission of image data from outside the source driver and stopping display. However, in order to perform such processing after an error is detected, it is necessary to perform communication with the external device, so there is a problem that a communication may error.

In addition, in the display system of the related art, when a signal abnormality or a connection abnormality with respect to an external device is detected, a control unit in the source driver performs control of turning off display on a display panel. However, there are problems that, when an image is originally displayed on the display panel, a user may not notice the change in the screen even if the display is turned off, and may not notice the occurrence of a signal abnormality or a connection abnormality. In addition, since the display of the display panel can be turned off even when an abnormality occurs in a battery or other electrical system, there are problems that the user may not notice that the reason therefor is a signal abnormality or a connection abnormality In addition, in a display device configured to control a gate driver by a source driver, it is possible to prevent display distortion due to noise or the like when the source driver that has detected an abnormality stops an output of a gate control signal. However, if noise is continuously generated for a certain period or a signal line is disconnected, a state in which the display screen is fixed continues when the problem occurs. Therefore, there is a difference between the screen that is actually displayed and the original screen that should be displayed. For example, in an in-vehicle display device used as an electronic mirror, there is a problem that the driver may misinterpret the situation.

SUMMARY

A display device according to the disclosure includes a display panel including a plurality of data lines and a plurality of gate lines, and a plurality of pixel switches and a plurality of pixel units which are provided in a matrix at intersections of the plurality of data lines and the plurality of gate lines; a display controller configured to output a video data signal; a gate driver configured to supply a gate signal that controls the pixel switch such that it is turned on to the plurality of gate lines; and a plurality of source drivers which are arranged in an extension direction of the gate lines, each of which receives the video data signal from the display controller, and generate a gradation voltage signal to be supplied to each of the plurality of pixel units based on the video data signal, wherein each of the plurality of source drivers includes a data processing unit configured to detect that an abnormality has occurred in communication with the display controller and share an abnormal state sharing signal indicating whether an abnormality has occurred in communication with the display controller in each of the plurality of source drivers with other source drivers, and when the abnormal state sharing signal indicates that an abnormality has occurred in communication with the display controller, supply a gradation voltage signal corresponding to predetermined gradation data different from a gradation voltage signal based on the video data signal to each of the plurality of pixel units.

In addition, a source driver according to the disclosure is connected to a display panel including a plurality of data lines and a plurality of gate lines, and a plurality of pixel switches and a plurality of pixel units which are provided in a matrix at intersections of the plurality of data lines and the plurality of gate lines, wherein the source driver is used by being arranged in a plurality along an extension direction of the gate lines, receives a video data signal from a display controller, generate a gradation voltage signal based on the received video data signal, and supplies the gradation voltage signal to the plurality of pixel units, and the source driver includes: a data processing unit configured to detect that an abnormality has occurred in communication with the display controller and share an abnormal state sharing signal indicating whether an abnormality has occurred in communication with the display controller with other source drivers, and, when the abnormal state sharing signal indicates that an abnormality has occurred in communication with the display controller, supply a gradation voltage signal corresponding to predetermined gradation data different from a gradation voltage signal based on the video data signal to each of the plurality of pixel units.

BRIEF DESCRIPTION OF THE DRAWINGS

FIG. 5 is a diagram schematically showing outputs of source drivers of respective channels during abnormality detection.

DESCRIPTION OF THE EMBODIMENTS

Figure 1:
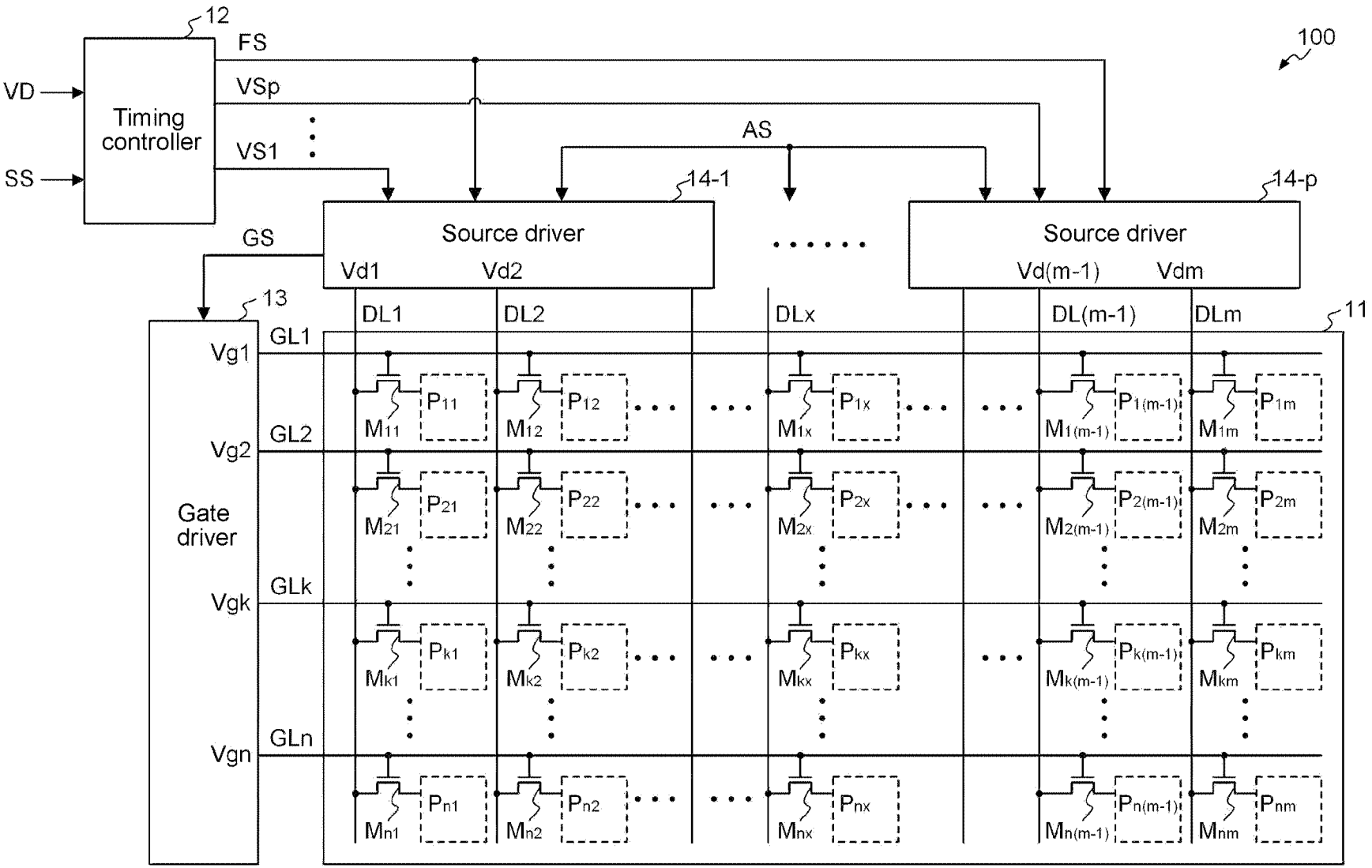
FIG. 1 is a block diagram showing a configuration of a display device according to the disclosure.

The disclosure has been made in view of the above problems, and the disclosure provides a source driver and a display device that can present the occurrence of an abnormality visually in an easy-to-understand manner when it is detected that an abnormality has occurred in communication between a timing controller and a source driver.

According to the display device of the disclosure, it is possible to visually present the occurrence of an abnormality in communication between a timing controller and a source driver.

Preferable embodiments of the disclosure will be described below in detail. Here, in the description and appended drawings in the following embodiments, substantially the same or equivalent components are denoted with the same reference numerals.

Embodiment 1

FIG. 1 is a block diagram showing a configuration of a display device 100 according to the disclosure. The display device 100 is an active matrix drive type liquid crystal display device. The display device 100 includes a display panel 11, a timing controller 12, a gate driver 13, and source drivers 14-1 to **14-*p***.

The display panel 11 is composed of a semiconductor substrate in which a plurality of pixel units P11 to Pnm and pixel switches M11 to Mnm (n is an integer of 2 or more, and m is an integer of 2 or more and is a multiple of 3) are arranged in a matrix of n rows×m columns. The display panel 11 includes n gate lines GL1 to GLn which are horizontal scanning lines and m data lines DL1 to DLm which are arranged to intersect and be orthogonal to the gate lines. The pixel units P11 to Pnm and the pixel switches M11 to Mnm are provided at intersections of the gate lines GL1 to GLn and the data lines DL1 to DLm and arranged in a matrix.

The pixel switches M11 to Mnm are controlled to be on or off according to gate signals Vg1 to Vgn supplied from the gate driver 13. The pixel units P11 to Pnm receive supply of gradation voltage signals Vd1 to Vdm corresponding to video data from the source drivers 14-1 to **14-*p*. When the pixel switches M11 to Mnm are turned on, the gradation voltage signals Vd1 to Vdm are applied to pixel electrodes of the pixel units P11 to Pnm and the pixel electrodes are charged. The brightness of the pixel units P11 to Pnm is controlled according to the gradation voltage signals Vd1 to Vdm in pixel electrodes of the pixel units P11** to Pnm, and displaying is performed.

In other words, according to an operation of the gate driver 13, m pixel units arranged in an extension direction of the gate lines (that is, one horizontal row) are selected as supply targets of the gradation voltage signals Vd1 to Vdm. The source drivers 14-1 to **14-*p* apply the gradation voltage signals Vd1 to Vdm to the selected pixel units in one horizontal row and cause a color to be displayed according to the voltage. While selectively switching pixel units of one horizontal row selected as supply targets of the gradation voltage signals Vd1** to Vdm, repeating is performed in an extension direction (that is, a longitudinal direction) of the data line, and thus screen display for one frame is performed.

In the present example, the gate driver 13 scans the gate lines GL1 to GLn (that is, supply of the gate signals Vg1 to Vgn) from the position closest to the gate driver 13 in a direction away from the gate driver 13. In addition, the gate driver 13 sequentially selects gate lines as supply targets of the gate signals Vg1 to Vgn in an order from the gate lines GL1 to GLn (that is, the order from the gate line at a position closest to the source drivers 14-1 to **14-*p* to the gate line furthest away therefrom). Thereby, in an order from the position closest to the gate driver 13 to the position further away therefrom in the extension direction of the gate lines, and in an order from the position closest to the source drivers 14-1 to 14-*p* to the position furthest away therefrom in the extension direction of the data line, a gradation voltage signal Vd is sequentially applied to pixel electrodes of the pixel units P11** to Pnm, and screen display for one frame is performed.

Here, the pixel units P11 to Pnm correspond to three pixels of R (red), G (green), and B (blue) for each of three adjacent pixel units (that is, 3ch pixel units) among m pixel units arranged in the extension direction of the gate lines. That is, if j=(⅓)m, 1ch, 4ch, . . . (3j-2)ch correspond to "R", 2ch, 5ch, . . . (3j-1)ch correspond to "G", and 3ch, 6ch, . . . 3jch correspond to "B." For example, one color is expressed by a combination of R, G, and B of 1ch, 2ch, and 3ch.

When the display device 100 is a liquid crystal display device, each of the pixel units P11 to Pnm includes a transparent electrode connected to a data line via a pixel switch and a liquid crystal enclosed between counter substrates which are provided to face a semiconductor substrate and in which one transparent electrode is formed on the entire surface. With respect to a backlight inside the display device, when the transmittance of the liquid crystal is changed according to a voltage difference between the gradation voltage signals Vd1 to Vdm supplied to the pixel units P11 to Pnm and the counter substrate voltage, displaying is performed.

The timing controller 12 generates, based on video data VD, serialized video data signals VS1 to VSp composed of a series of pixel data pieces PD representing the brightness level of each pixel, for example, with an 8-bit 256-level brightness gradation. The video data signals VS1 to VSp are composed of a series of pixel data pieces PD provided in a number corresponding to the number of data lines in which each of the source drivers 14-1 to 14-*p* is responsible for source output.

In addition, the timing controller 12 generates a frame synchronization signal FS based on a synchronization signal SS and supplies it to the source drivers 14-1 to 14-*p*.

The gate driver 13 receives supply of a gate control signal GS from the source driver 14-1, and sequentially supplies the gate signals Vg1 to Vgn to the gate lines GL1 to GLn based on a clock timing included in the gate control signal GS.

The source drivers 14-1 to 14-*p* are formed as driver integrated circuits (IC) provided for each of the number of data lines obtained by dividing the data lines DL1 to DLm according to the resolution of the display panel 11. The source drivers 14-1 to 14-*p* are arranged in the extension direction of the gate lines and form a source driver group including a first stage to a $p^{th}$ stage (hereinafter referred to as a final stage) source drivers based on the scanning direction.

The source drivers 14-1 to 14-*p* have source outputs of channels (hereinafter referred to as ch) corresponding to the number of data lines driven by each of them. Each source output corresponds to three pixels of R (red), G (green), and B (blue) for each 3ch.

The source drivers 14-1 to 14-*p* capture the pixel data pieces PD included in the video data signals VS1 to VSp supplied from the timing controller 12 for each one horizontal scanning line (that is, for the number of chs corresponding to each source driver of the pixel data piece PD for one horizontal scanning line) and generate the gradation voltage signals Vd1 to Vdm corresponding to the brightness gradation shown in the captured pixel data piece PD. Then, the source drivers 14-1 to 14-*p* apply the generated gradation voltage signals Vd1 to Vdm as source outputs to the data lines DL1 to DLm of the display panel 11.

In addition, among the source drivers 14-1 to 14-*p*, the source driver 14-1 which is a source driver arranged at a position closest to the gate driver 13 (for example, in the present embodiment, the leftmost source driver) generates a gate control signal GS based on the frame synchronization signal FS, and supplies it to the gate driver 13.

In addition, each of the source drivers 14-1 to 14-*p* has a function of detecting an abnormality in communication of the video data signals VS1 to VSp and communication of the frame synchronization signal FS with the timing controller 12. In addition, each of the source drivers 14-1 to 14-*p* shares an abnormal state sharing signal AS indicating whether a communication abnormality has been detected with other source drivers.

Each of the source drivers 14-1 to 14-*p* changes the signal level of the abnormal state sharing signal AS when an abnormality is detected in communication between the timing controller 12 and any of the source drivers 14-1 to 14-*p*. Each of the source drivers 14-1 to 14-*p* outputs the gradation voltage signals Vd1 to Vdm according to the change in the signal level of the abnormal state sharing signal AS due to the operation of the source driver itself or other source drivers based on predetermined gradation data different from those of the video data signals VS1 to VSp supplied from the timing controller 12. In the following description, this operation mode will be referred to as a "self-running mode." In addition, in a normal state in which no communication abnormality has been detected, that is, when the abnormal state sharing signal AS indicates that no communication abnormality has been detected, a normal operation mode in which the gradation voltage signals Vd1 to Vdm are output based on supply of the video data signals VS1 to VSp and the frame synchronization signal FS from the timing controller 12 is referred to as a "normal mode."

Figure 2:
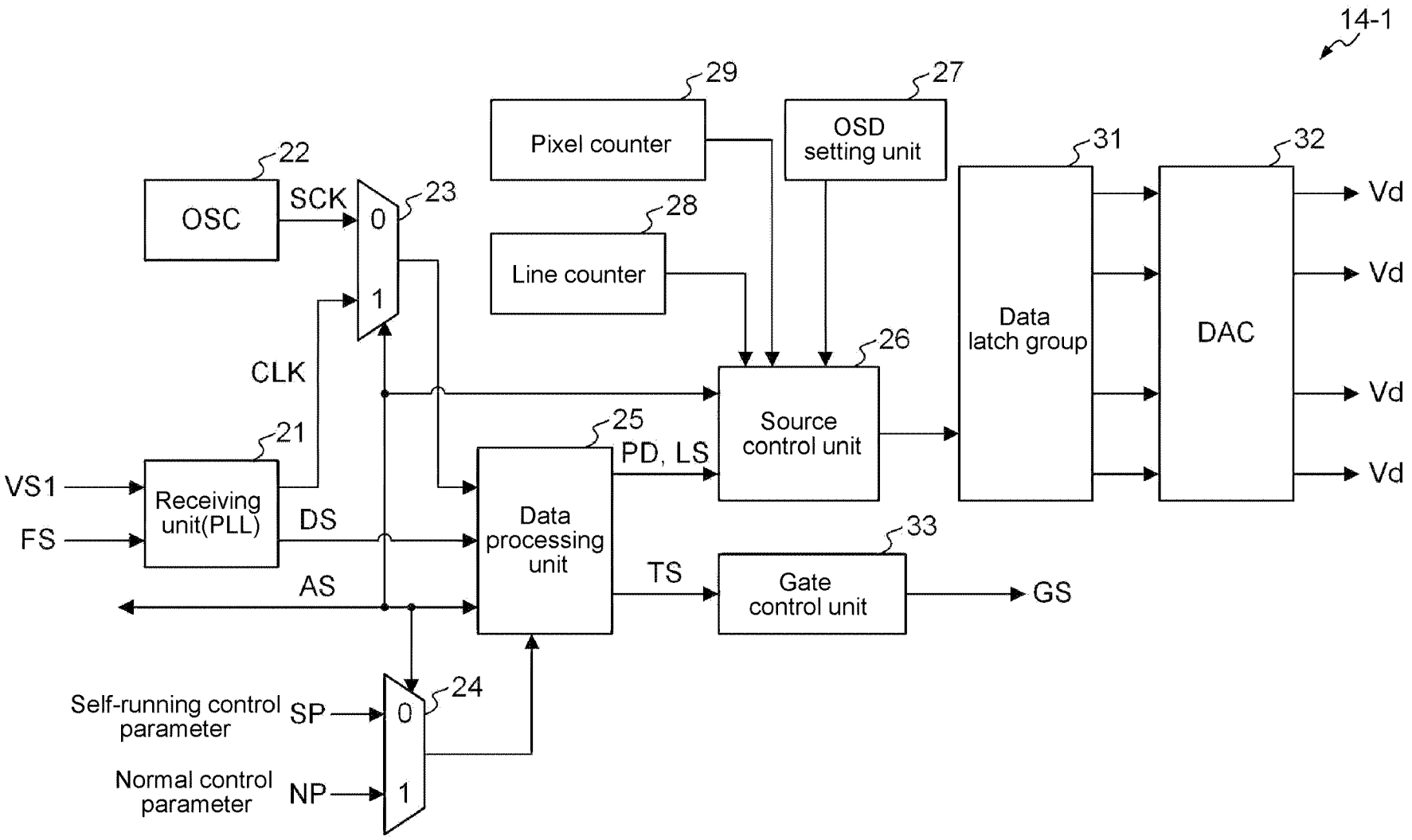
FIG. 2 is a block diagram showing a configuration of a source driver of Embodiment 1.

FIG. 2 is a block diagram showing a configuration of the source driver 14-1 of the present embodiment. The source driver 14-1 includes a receiving unit (PLL) 21, an oscillator (OSC) 22, a selector 23, a selector 24, a data processing unit 25, a source control unit 26, an OSD setting unit 27, a line counter 28, a pixel counter 29, a data latch group 31, a DA converter 32 and a gate control unit 33.

The receiving unit 21 receives the video data signal VS1 and the frame synchronization signal FS supplied from the timing controller 12. The receiving unit 21 includes a phase locked loop (PLL) circuit and generates a clock signal CLK based on the video data signal VS1 and the frame synchronization signal FS. In addition, the receiving unit 21 generates a serial data signal DS in synchronization with the clock signal CLK and supplies it to the data processing unit 25.

The oscillator 22 (in FIG. 2, shown as OSC) is an oscillation circuit that oscillates at a predetermined frequency (fixed frequency) that is set in advance. The oscillator 22 generates and outputs a built-in oscillation clock signal SCK by oscillation. Here, the oscillation frequency of the oscillator 22 is set in advance so that the frequency is common among the source drivers 14-1 to 14-*p*.

The selector 23 is a selector that receives an input of the clock signal CLK output from the receiving unit 21 and the built-in oscillation clock signal SCK output from the oscillator 22 and selectively switches which signal is to be output. The selector 23 switches the output according to the signal level of the abnormal state sharing signal AS. Specifically, the selector 23 outputs the clock signal CLK when the signal level of the abnormal state sharing signal AS is logical level 1 (also referred to as an H level) and outputs the built-in oscillation clock signal SCK when the signal level of the abnormal state sharing signal AS is logical level 0 (also referred to as an L level). The clock signal CLK or the built-in oscillation clock signal SCK output from the selector 23 is supplied to the data processing unit 25.

The selector 24 is a selector that selectively outputs either a self-running control parameter SP or a normal control parameter NP. The selector 24 switches the output according to the signal level of the abnormal state sharing signal AS.

The self-running control parameter SP and the normal control parameter NP are stored in a storage device (not shown) such as a semiconductor memory provided inside the source driver 14-1. The self-running control parameter SP and the normal control parameter NP include information (for example, the clock timing of the gate clock signal or the like) for controlling the output of the gate signals Vg1 to Vgn by the gate driver 13.

The normal control parameter NP is a parameter used for controlling the gate driver 13 in the normal mode. On the other hand, the self-running control parameter SP is a parameter used for controlling the gate driver 13 in the self-running mode.

When the signal level of the abnormal state sharing signal AS is the H level, the selector 24 outputs the normal control parameter NP. The output normal control parameter NP is supplied to the data processing unit 25. In addition, when the signal level of the abnormal state sharing signal AS is the L level, the selector 24 outputs the self-running control parameter SP. The output self-running control parameter SP is supplied to the data processing unit 25.

The data processing unit 25 performs serial to parallel conversion on the data signal DS, generates a parallel pixel data piece PD, and supplies it to the source control unit 26.

In addition, the data processing unit 25 generates a horizontal synchronization signal LS and supplies it to the source control unit 26. For example, when the abnormal state sharing signal AS is the H level (that is, the normal mode), the data processing unit 25 generates a horizontal synchronization signal LS based on the data signal DS supplied from the receiving unit 21. On the other hand, when the abnormal state sharing signal AS is the L level (that is, the self-running mode), the data processing unit 25 generates a horizontal synchronization signal LS based on the built-in oscillation clock signal SCK supplied via the selector 23.

In addition, the data processing unit 25 generates a timing control signal TS used for controlling the gate driver 13 based on the clock signal supplied via the selector 23 (that is, the clock signal CLK or the built-in oscillation clock signal SCK) and the self-running control parameter SP or the normal control parameter NP supplied via the selector 24.

In addition, the data processing unit 25 includes an abnormal state detection circuit (not shown) that detects whether there is an abnormality in communication between the timing controller 12 and the source driver 14-1. The abnormal state detection circuit includes, for example, a CRC calculation circuit that detects a data transmission error using a cyclic redundancy check (CRC) code. In addition, the abnormal state detection circuit includes a disconnection detection circuit that detects a disconnection of a signal line that connects the timing controller 12 to the source driver 14-1. For example, the disconnection detection circuit detects that the signal line is disconnected based on whether there is image data transition between frames. That is, the abnormal state detection circuit provided in the data processing unit 25 detects a data transmission error and a signal line disconnection as a communication abnormality.

The data processing unit 25 outputs the abnormal state sharing signal AS indicating whether a communication abnormality has been detected. The abnormal state sharing signal AS is, for example, an output of an open drain terminal commonly connected between source drivers, and has an L level of signal level if a communication abnormality is detected in any of the source drivers and has an H level of signal level if no communication abnormality is detected in any of the source drivers.

The source control unit 26 controls a capture operation of the pixel data piece PD of the data latch group 31 based on data mapping determined based on the gate lines GL1 to GLn and the data lines DL1 to DLm, and the like.

Specifically, when the abnormal state sharing signal AS is the H level (that is, the normal mode), the source control unit 26 supplies the parallel pixel data piece PD supplied from the data processing unit 25 to a first latch of the data latch group 31 and sequentially stores the pixel data piece PD according to the data mapping. In addition, the source control unit 26 supplies the horizontal synchronization signal LS generated based on the data signal DS to a second latch of the data latch group 31 and stores the pixel data piece PD by using the horizontal synchronization signal LS as a capture clock.

On the other hand, when the abnormal state sharing signal AS is the L level (that is, the self-running mode), based on setting data of the OSD setting unit 27, the source control unit 26 stores a pixel data piece corresponding to the gradation data for displaying an abnormality notification screen on the display panel 11 (hereinafter referred to as a gradation data piece) in the first latch of the data latch group 31 according to timings of the line counter 28 and the pixel counter 29. In addition, the source control unit 26 uses the horizontal synchronization signal LS generated based on the built-in oscillation clock signal SCK as a capture clock and stores the gradation data piece based on the setting of the OSD setting unit 27 in the second latch.

The OSD setting unit 27 supplies setting data for displaying an on screen display (OSD) image on the display panel 11 to the source control unit 26. The setting data includes information on the control of the brightness of each of the pixel units P11 to Pnm for displaying the abnormality notification screen which is a display screen during abnormality detection. On the abnormality notification screen, for example, a plurality of pixel units provided at predetermined positions on the display panel 11 are selected as shown with an "x" shape symbol, the gradation voltage signal Vd with a white gradation is written in the selected pixel units, and the gradation voltage signal Vd with a black gradation is written in other pixel units.

The line counter 28 is a counter that sequentially counts the gate lines GL1 to GLn in the order corresponding to the selection order of the gate lines GL1 to GLn by the gate driver 13 (that is, the selection order of the gate signals Vg1 to Vgn as supply targets). During abnormality detection, in synchronization with the count of the line counter 28, the gradation data piece for each line is stored in the first latch of the data latch group 31.

The pixel counter 29 is a counter that sequentially counts pixel units for one row in the extension direction of one gate line in the scanning direction of the gate signals Vg1 to Vgn by the gate driver 13. During abnormality detection, in synchronization with the count of the pixel counter 29, a gradation data piece for each pixel is stored in the second latch of the data latch group 31.

The data latch group 31 is composed of a plurality of latch circuits that capture a pixel data piece PD in the normal mode and capture a gradation data piece in the self-running mode. The data latch group 31 includes a first latch and a second latch (not shown). The first latch captures the pixel data piece PD or the gradation data piece for one row according to the control of the source control unit 26. The second latch captures the pixel data piece PD or the gradation data piece stored in the first latch for each pixel according to the control of the source control unit 26. The second latch captures the pixel data piece PD or the gradation data piece from the first latch at the rising of the horizontal synchronization signal LS.

The DA converter 32 selects a gradation voltage corresponding to the pixel data piece PD or gradation data piece output from the data latch group 31 and performs digital to analog conversion to generate an analog gradation voltage signal Vd. The generated analog gradation voltage signal Vd is amplified by an output amplifier (not shown) and output.

The gate control unit 33 generates a gate control signal GS based on a timing signal TS supplied from the data processing unit 25 and controls the gate driver 13.

As described above, the source driver 14-1 has the oscillator 22, the OSD setting unit 27, the line counter 28 and the pixel counter 29 which are provided to respond during abnormality detection (that is, the self-running mode). Here, the source drivers 14-2 to **14-*p* also have the same configuration as the source driver 14-1. However, since only the source driver 14-1 controls the gate driver 13, the gate control signal GS output from the gate control unit 33 of the other source drivers 14-2 to 14-*p* is not supplied to the gate driver 13**.

Next, operations of the display device 100 of the present embodiment will be described with reference to the time chart in FIG. 3A.

[Normal Mode]

When an abnormality in communication with the timing controller 12 is not detected in all of the source drivers, the abnormal state sharing signal AS with an H level is supplied to each of the source drivers 14-1 to **14-*p***.

In addition, the frame synchronization signal FS is supplied to each of the source drivers 14-1 to **14-*p* from the timing controller 12. Each of the receiving units 21 of the source drivers 14-1 to 14-*p* receives a video data signal (in FIG. 3A, shown as VS) transmitted from the timing controller 12**.

The selector 23 of each of the source drivers 14-1 to **14-*p* supplies the clock signal CLK output from the receiving unit 21 (that is, a clock signal generated by a PLL circuit in the receiving unit 21) to the data processing unit 25. The data processing unit 25 operates based on the clock signal CLK and supplies the pixel data piece PD and the horizontal synchronization signal LS to the source control unit 26. In addition, the data processing unit 25 supplies the timing signal TS generated based on the clock signal CLK to the gate control unit 33**.

The source control unit 26 stores the pixel data piece PD in the data latch group 31. The DA converter 32 selects a gradation voltage corresponding to the pixel data piece PD, and performs D/A conversion to generate an analog gradation voltage signal Vd. The generated analog gradation voltage signal Vd is amplified and output as a source output. The source output for one frame is output for each frame period indicated by the frame synchronization signal FS. In FIG. 3A, the source output for one frame in the normal mode is shown as a normal output.

[Self-Running Mode]

When an abnormality in communication with the timing controller 12 in any of the source drivers 14-1 to **14-*p* is detected, the data processing unit 25 of the source driver that has detected an abnormality outputs the abnormal state sharing signal AS with an L level. The abnormal state sharing signal AS with an L level is supplied to each of the source drivers 14-1 to 14-*p***.

The selector 23 of each of the source drivers 14-1 to **14-*p* performs switching according to the change from the H level to the L level of the abnormal state sharing signal AS with an L level and supplies the built-in oscillation clock signal SCK output from the oscillator 22 to the data processing unit 25**.

The data processing unit 25 generates a horizontal synchronization signal LS based on the built-in oscillation clock signal SCK and supplies it to the source control unit 26. In addition, the data processing unit 25 generates a timing signal TS based on the built-in oscillation clock signal SCK and supplies it to the gate control unit 33.

The source control unit 26 refers to the counts of the line counter 28 and the pixel counter 29 and stores the gradation data piece in the data latch group 31 based on the OSD setting by the OSD setting unit 27. The DA converter 32 selects a gradation voltage corresponding to the gradation data piece, and performs D/A conversion to generate an analog gradation voltage signal Vd. The generated analog gradation voltage signal Vd is amplified and output as a source output.

Figure 3A:
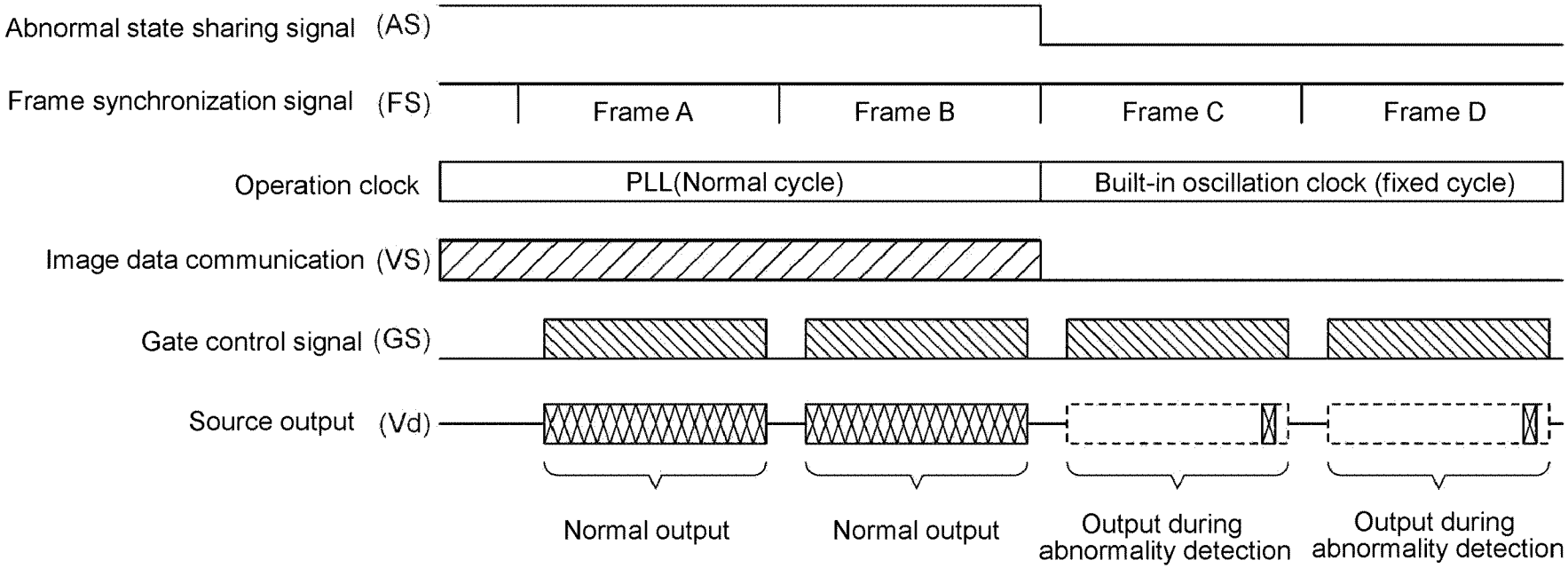
FIG. 3A is a time chart showing operations of respective parts of a source driver of Embodiment 1.

In FIG. 3A, a source output for one frame in the self-running mode is shown as an output during abnormality detection. At the output during abnormality detection, the gradation voltage signal Vd with a black gradation is applied as a source output to a pixel unit at a timing indicated by a dashed line, and a source output including the gradation voltage signal Vd with a white gradation is applied to a pixel unit at a timing marked with the mark x indicated by a solid line.

Figure 3B:
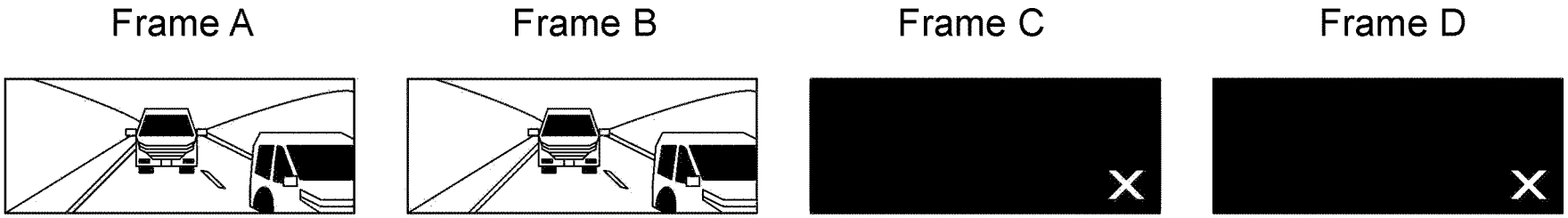
FIG. 3B is a diagram schematically showing a display screen during a normal operation and abnormality detection in Embodiment 1.

FIG. 3B is a diagram showing an embodiment of a screen displayed on the display panel 11 in each of the normal mode and the self-running mode. Here, a case in which the display device 100 is used as an in-vehicle electronic mirror has been exemplified.

On the display screen in the normal mode shown as a frame A and a frame B, the display panel 11 displays a scene such as vehicles located behind the vehicle in which the display device 100 is mounted and roads behind the vehicle.

In the self-running mode, according to the OSD display setting by the OSD setting unit, an abnormality notification screen is displayed on the display panel 11. For example, as shown as a frame C and a frame D in FIG. 3B, a screen which includes a region marked with "x" drawn in white at the lower right part in the display screen and other regions displayed in black as a whole is displayed as an abnormality notification screen on the display panel 11.

Figure 4:
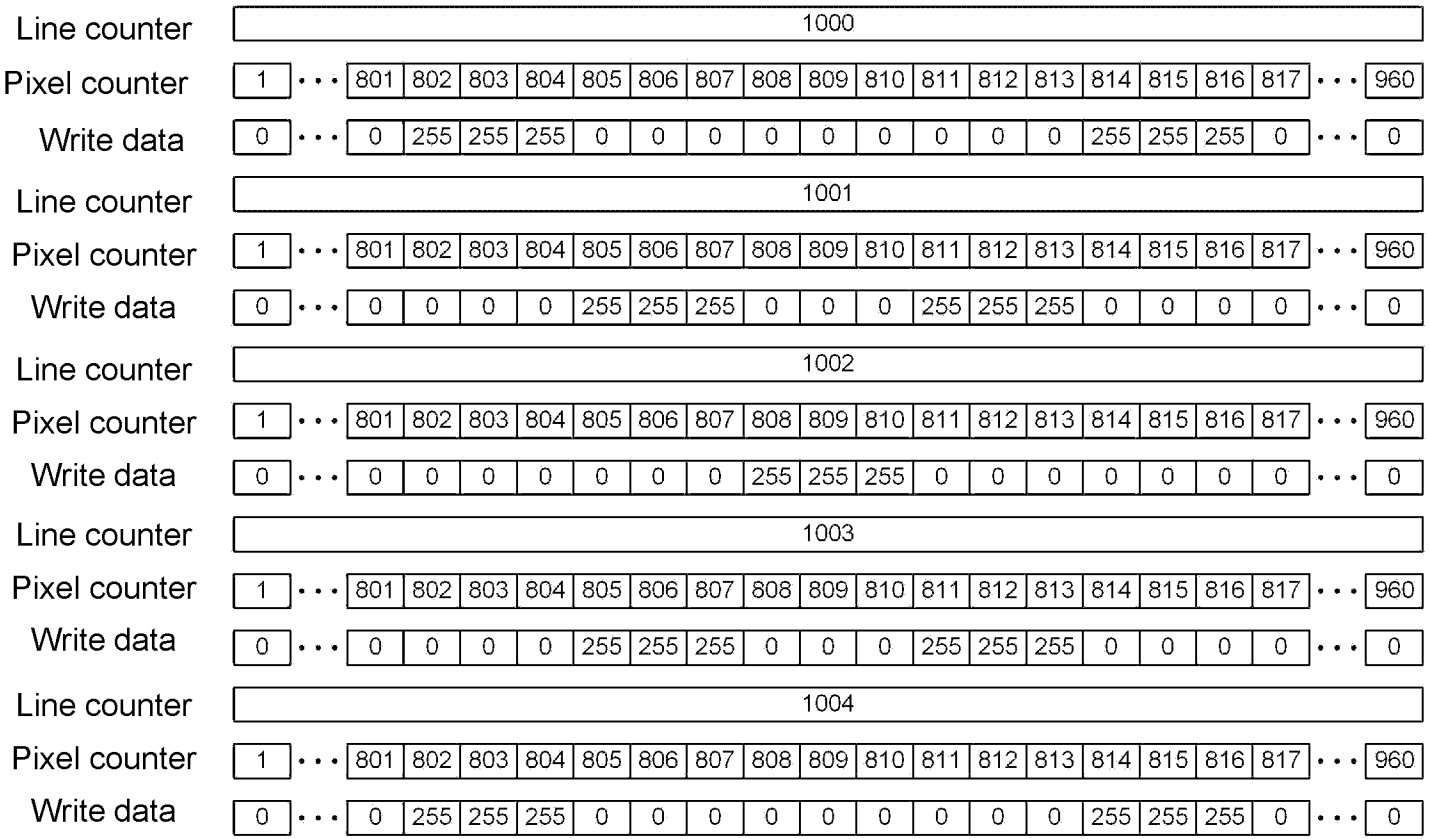
FIG. 4 is a diagram showing an example of values of counters and write data during abnormality detection.

FIG. 4 is a diagram showing the relationship between the gradation data piece (in FIG. 4, shown as write data) written in each pixel unit in order to display such an abnormality notification screen and the count values of the line counter 28 and the pixel counter 29. Here, a case in which the number of gate lines is 1,080 and the number of data lines is 960 (that is, n=1,080, m=960) has been exemplified.

During a period in which the count value of the line counter 28 is 1 to 999 (not shown in FIG. 4), the data latch group 31 latches write data having a pixel value of 0 (that is, black). Thereby, the gradation voltage signal Vd corresponding to the write data having a pixel value of 0 is applied from the pixel unit (P11) in the $1^{st}$ row and the $1^{st}$ column to pixel units in the $999^{th}$ row and the $960^{th}$ column.

When the count value of the line counter 28 is 1,000, the data latch group 31 latches a gradation data piece having a pixel value of 255 (that is, white) as write data corresponding to pixel units corresponding to the count values of 802 to 804 and pixel units corresponding to the count values of 814 to 816 of the pixel counter 29. In addition, the data latch group 31 latches a gradation data piece having a pixel value of 0 (that is, black) as write data for the other pixel units, that are, pixel units corresponding to the count values of 1 to 801, 805 to 813, and 817 to 960 of the pixel counter 29.

Thereby, the gradation voltage signal Vd corresponding to the gradation data piece having a pixel value of 1 is applied to the pixel units in the $1{,}000^{th}$ row and 802 to $804^{th}$ columns and the 814 to $816^{th}$ columns. The gradation voltage signal Vd corresponding to the gradation data piece having a pixel value of 0 is applied to the other pixel units in the $1{,}000^{th}$ row. Here, the count value of 802 of the pixel counter 28 corresponds to the pixel R, the count value of 803 corresponds to the pixel G, and the count value of 804 corresponds to the pixel B. Similarly, the count value of 814 of the pixel counter 28 corresponds to the pixel R, the count value of 815 corresponds to the pixel G, and the count value of 816 corresponds to the pixel B.

When the count value of the line counter 28 is 1,001, the data latch group 31 latches a gradation data piece having a pixel value of 255 as write data for pixel units corresponding to the count values of 805 to 807 and pixel units corresponding to the count values of 811 to 813 of the pixel counter 29. In addition, the data latch group 31 latches gradation data having a pixel value of 0 as write data for the other pixel units, that is, pixel units corresponding to the count values of 1 to 804, 808 to 810, and 814 to 960 of the pixel counter 29.

Thereby, the gradation voltage signal Vd corresponding to the gradation data piece having a pixel value of 1 is applied to the pixel units in the $1{,}001^{st}$ row and the 805 to $807^{th}$ columns and the 811 to $813^{th}$ columns. The gradation voltage signal Vd corresponding to the gradation data piece having a pixel value of 0 is applied to the other pixel units in the $1{,}001^{st}$ row. Here, the count value of 805 of the pixel counter 28 corresponds to the pixel R, the count value of 806 corresponds to the pixel G, and the count value of 807 corresponds to the pixel B. Similarly, the count value of 811 of the pixel counter 28 corresponds to the pixel R, the count value of 812 corresponds to the pixel G, and the count value of 813 corresponds to the pixel B.

When the count value of the line counter 28 is 1,002, the data latch group 31 latches a gradation data piece having a pixel value of 255 as write data for pixel units corresponding to the count values of 808 to 810 of the pixel counter 29. In addition, the data latch group 31 latches a gradation data piece having a pixel value of 0 as write data for the other pixel units, that are, pixel units corresponding to the count values of 1 to 807, 811 to 960 of the pixel counter 29.

Thereby, the gradation voltage signal Vd corresponding to the gradation data piece having a pixel value of 1 is applied to the pixel units in the $1{,}002^{nd}$ row and the 808 to $810^{th}$ columns. The gradation voltage signal Vd corresponding to the gradation data piece having a pixel value of 0 is applied to the other pixel units in the $1{,}002^{nd}$ row. Here, the count value of 808 of the pixel counter 28 corresponds to the pixel R, the count value of 809 corresponds to the pixel G, and the count value of 810 corresponds to the pixel B.

When the count value of the line counter 28 is 1,003, the data latch group 31 latches a gradation data piece having a pixel value of 255 as write data for pixel units corresponding to the count values of 805 to 807 and pixel units corresponding to the count values of 811 to 813 of the pixel counter 29. In addition, the data latch group 31 latches a gradation data piece having a pixel value of 0 as write data for the other pixel units, that are, pixel units corresponding to the count values of 1 to 804, 808 to 810, and 814 to 960 of the pixel counter 29.

Thereby, the gradation voltage signal Vd corresponding to the gradation data piece having a pixel value of 1 is applied to the pixel units in the $1003^{rd}$ row and the 805 to $807^{th}$ columns and the 811 to $813^{rd}$ columns. The gradation voltage signal Vd corresponding to the gradation data piece having a pixel value of 0 is applied to the other pixel units in the $1003^{rd}$ row.

When the count value of the line counter 28 is 1,004, the data latch group 31 latches a gradation data piece having a pixel value of 255 as write data for pixel units corresponding to the count values of 802 to 804 and pixel units corresponding to the count values of 814 to 816 of the pixel counter 29. In addition, the data latch group 31 latches a gradation data piece having a pixel value of 0 as write data for the other pixel units, that are, pixel units corresponding to the count values of 1 to 801, 805 to 813, and 817 to 960 of the pixel counter 29.

Thereby, the gradation voltage signal Vd corresponding to the gradation data piece having a pixel value of 1 is applied to the pixel units in the $1004^{th}$ row and 802 to $804^{th}$ columns and the 814 to $816^{th}$ columns. The gradation voltage signal Vd corresponding to the gradation data piece having a pixel value of 0 is applied to the other pixel units in the $1004^{th}$ row.

FIG. 5 is a diagram schematically showing outputs of source drivers of respective channels during abnormality detection. As described above, when the gradation voltage signal Vd corresponding to a pixel value of 0 and the gradation voltage signal Vd corresponding to a pixel value of 255 are selectively applied to the pixel units P11 to Pnm, an image in which the white marks x are displayed in an overall black display screen is displayed as an abnormality notification screen.

Here, the supply of the gradation voltage signals Vd1 to Vdm to the pixel units is actually carried out by the plurality of source drivers 14-1 to **14-*p* separately. Therefore, one or two source drivers positioned in the latter half of the source drivers 14-1 to 14-*p*** output the gradation voltage signal Vd for displaying the white gradation mark "x", and the other source drivers output the gradation voltage signal Vd for displaying simply the black gradation.

As described above, according to the display device 100 of the present embodiment, an abnormality in communication between the timing controller 12 and the source drivers 14-1 to **14-*p* is detected, and an abnormality notification screen for notifying the fact that a communication abnormality has occurred can be displayed on the display panel 11**. Thereby, it is possible to visually present the fact that a communication abnormality has occurred in an easy-to-understand manner for a user who views the display screen.

In addition, when a screen specialized for presenting the occurrence of the communication abnormality is displayed, fixing of the display screen does not occur like a case in which the output of a gate control signal is simply stopped in response to the detection of the communication abnormality. Therefore, when the display device 100 of the present embodiment is used as an in-vehicle electronic mirror, it is possible to prevent the driver from misidentifying the driving situation.

Embodiment 2

Next, Embodiment 2 of the disclosure will be described. The display device of Embodiment 2 is different from the display device 100 of Embodiment 1 in that an abnormality notification screen different from that of Embodiment 1 is displayed on the display panel 11.

Figure 6:
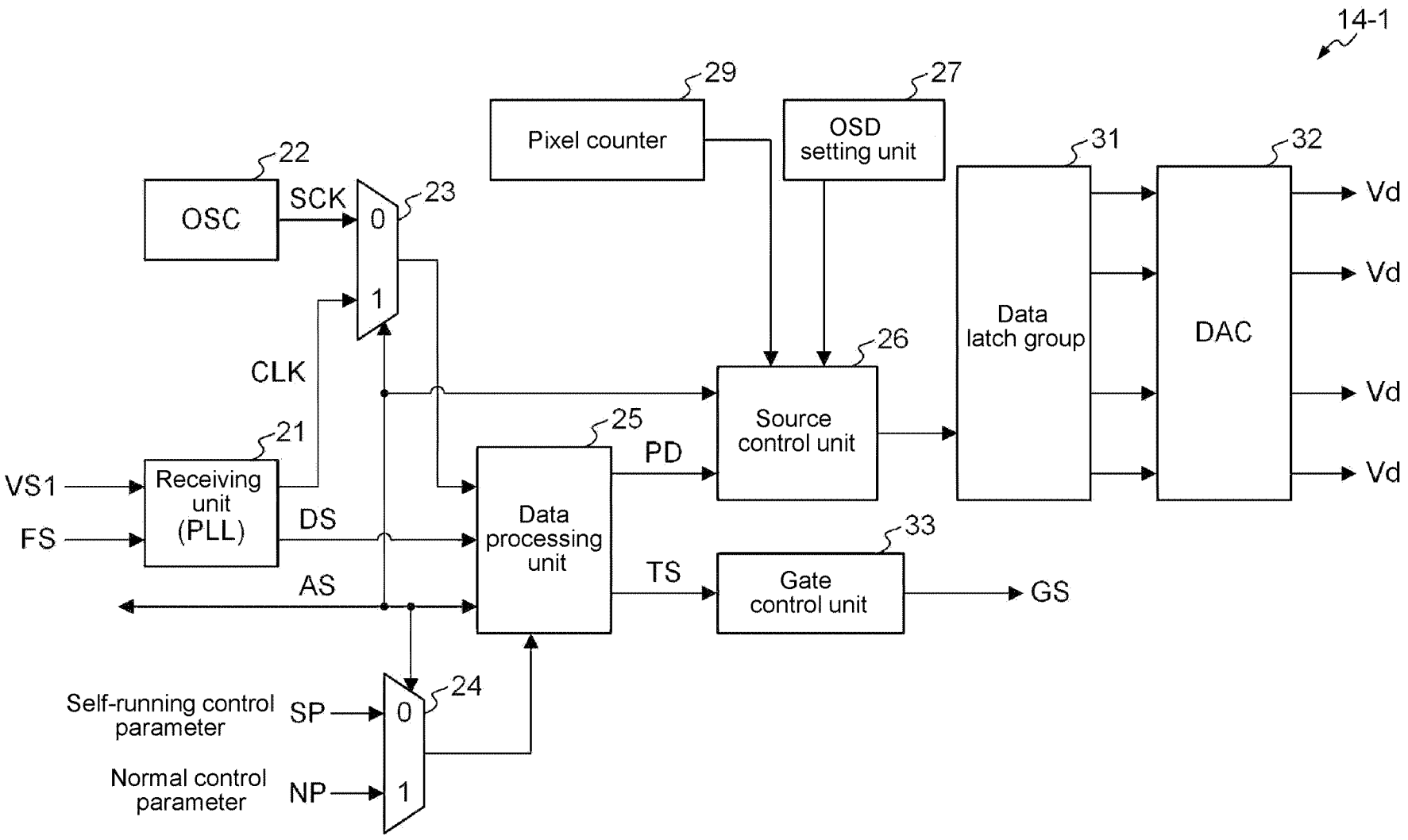
FIG. 6 is a block diagram showing a configuration of a source driver of Embodiment 2.

FIG. 6 is a block diagram showing a configuration of the source driver 14-1 of the display device of Embodiment 2. Here, the source drivers 14-2 to **14-*p*** also have the same configuration.

The source driver 14-1 of Embodiment 2 is different from the source driver 14-1 of Embodiment 1 shown in FIG. 2 in that it does not have the line counter 28.

Figure 7A:
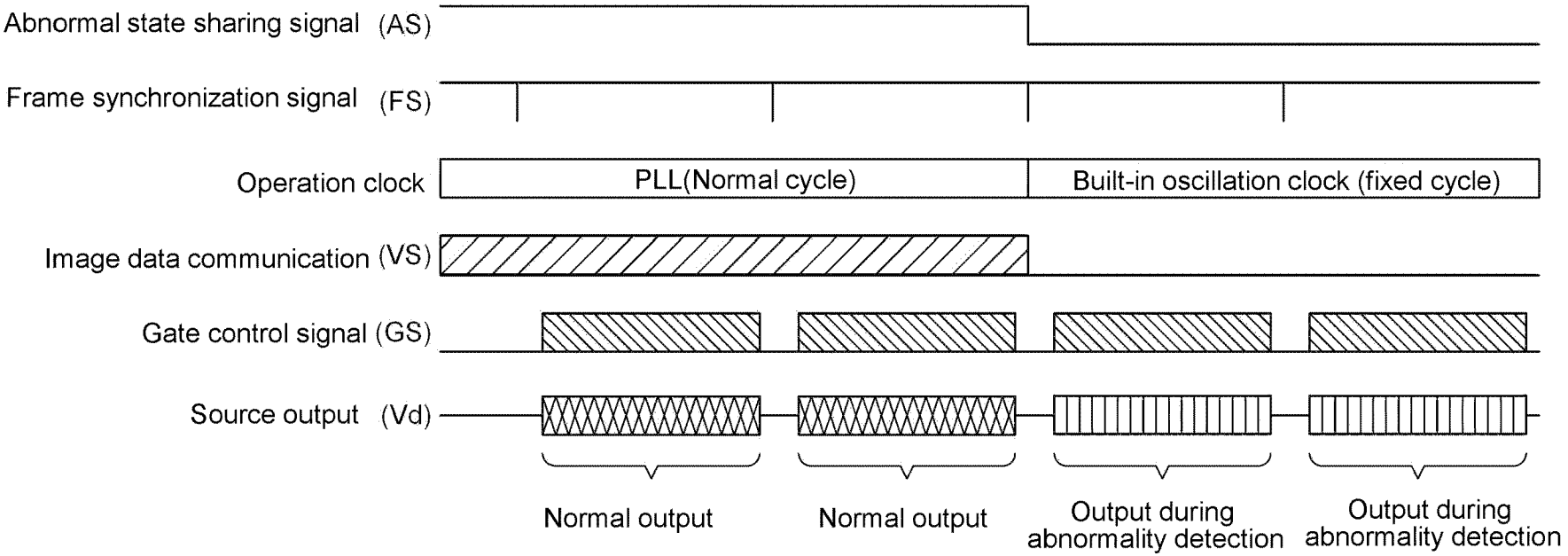
FIG. 7A is a time chart showing operations of respective parts of a source driver of Embodiment 2.

FIG. 7A is a time chart showing operations of the display device of Embodiment 2. The operations in the normal mode are the same as in Embodiment 1.

When an abnormality in communication with the timing controller 12 is detected in any of the source drivers 14-1 to **14-*p*, the abnormal state sharing signal AS supplied to the data processing unit 25 of each source driver becomes the L level. Thereby, the operation of the source driver 14-1** transitions to the self-running mode.

The source control unit 26 refers to the count of the pixel counter 29 and stores the gradation data piece in the data latch group 31 based on the OSD setting by the OSD setting unit 27. The DA converter 32 selects a gradation voltage corresponding to the gradation data piece, and performs D/A conversion to generate an analog gradation voltage signal Vd. The generated analog gradation voltage signal Vd is amplified and output as a source output.

In the output during abnormality detection of Embodiment 2, source output is performed such that the gradation voltage signal Vd corresponding to a pixel value that is different for each predetermined number of channels in the extension direction of the gate lines and corresponding to a pixel value that is the same in the extension direction of the data line is applied to the pixel unit and the output is applied to the pixel unit.

Figure 7B:
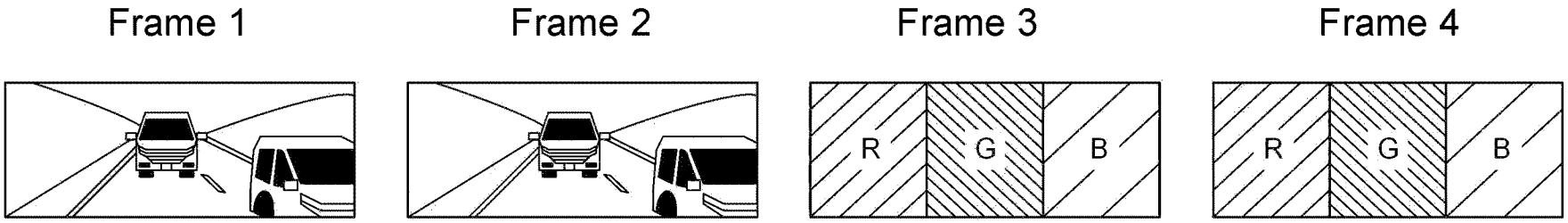
FIG. 7B is a diagram schematically showing a display screen during a normal operation and abnormality detection in Embodiment 2.

FIG. 7B is a diagram showing an embodiment of a screen displayed on the display panel 11 in each of the normal mode and the self-running mode.

When the display device of Embodiment 2 is used as an in-vehicle electronic mirror, on the display screen in the normal mode shown as a frame A and a frame B, a scene such as vehicles located behind the vehicle and roads behind the vehicle is displayed on the display panel.

On the other hand, in the self-running mode, according to the OSD display setting by the OSD setting unit, an abnormality notification screen is displayed on the display panel 11. For example, as shown as a frame C and a frame D in FIG. 7B, a screen in which the display screen is divided into three regions in the extension direction of the gate lines, and the regions are displayed in red (R), green (G), and blue (B) is the abnormality notification screen of the present embodiment.

Figure 8:
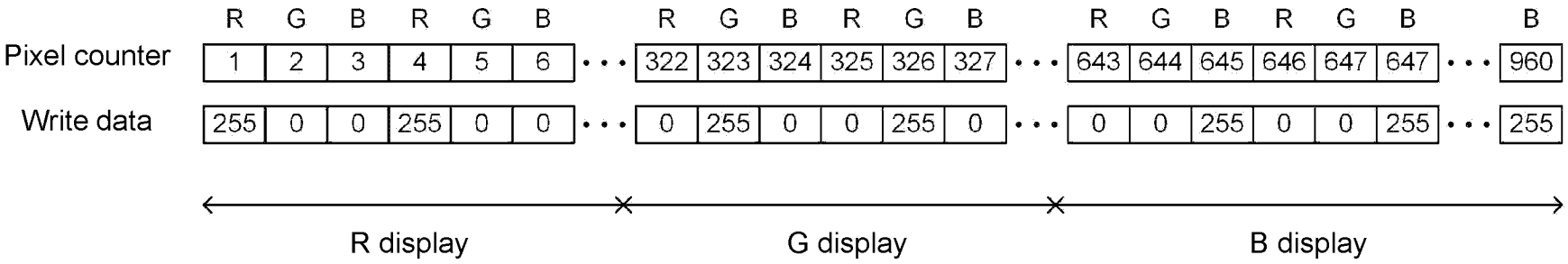
FIG. 8 is a diagram showing outputs of source drivers for each channel during abnormality detection.

FIG. 8 is a diagram showing outputs of source drivers for each channel during abnormality detection. For example, when the number of channels of the display panel 11 is 960, during a period in which the count value of the pixel counter 29 is 320 or less, the source drivers 14-1 to 14-*p* apply the gradation voltage signal Vd corresponding to a pixel value of 255 only to the pixel unit corresponding to "R" in RGB. Then, the source drivers 14-1 to 14-*p* apply the gradation voltage signal Vd corresponding to a pixel value of 0 to the other pixel units corresponding to "B" and "G."

In addition, during a period in which the count value of the pixel counter 29 is 321 to 640, the source drivers 14-1 to 14-*p* apply the gradation voltage signal Vd corresponding to a pixel value of 255 only to the pixel unit corresponding to "G" in RGB. Then, the source drivers 14-1 to 14-*p* apply the gradation voltage signal Vd corresponding to a pixel value of 0 to the other pixel units corresponding to "R" and "B."

In addition, during a period in which the count value of the pixel counter 29 is 641 to 960, the source drivers 14-1 to 14-*p* apply the gradation voltage signal Vd corresponding to a pixel value of 255 only to the pixel unit corresponding to "B" in RGB. Then, the source drivers 14-1 to 14-*p* apply the gradation voltage signal Vd corresponding to a pixel value of 0 to the other pixel units corresponding to "R" and "G."

Thereby, as shown in FIG. 7B, a screen in which the display screen is divided into three regions, a first region positioned on the left side is displayed in red (R), a second region positioned at the center is displayed in green (G), and a third region positioned on the right side is displayed in blue (B) is displayed as the abnormality notification screen.

As described above, the display device of the present embodiment displays a screen composed of three colors of RGB as the abnormality notification screen. Therefore, compared to the display device of Embodiment 1 in which the abnormality notification screen is composed in black and white monochrome, it is possible to vividly present the occurrence of the communication abnormality. Even in a situation in which it is difficult to visually recognize information on the display screen, such as the surroundings are dark, it is possible to present the occurrence of the communication abnormality in an easy-to-understand manner for the user.

In addition, the display device of the present embodiment displays the same pixel value in the extension direction of the data line (that is, the longitudinal direction of the display screen). Therefore, unlike the display device 100 of Embodiment 1, the line counter 28 is unnecessary. Accordingly, it is possible to minimize circuit scales of the source drivers 14-1 to 14-*p*.

Here, the disclosure is not limited to the above embodiment. For example, in the above embodiment, a case in which each of the source drivers 14-1 to 14-*p* has the oscillator 22, and each of the oscillators 22 oscillates at a common fixed frequency and generates a built-in oscillation clock signal SCK has been exemplified. However, a configuration in which one oscillator is provided outside the source drivers 14-1 to 14-*p* or inside a specific source driver, and the built-in oscillation clock signal SCK output from the oscillator is commonly used in the source drivers 14-1 to 14-*p* may be used.

In addition, while a case in which the receiving unit 21 is mounted in a PLL circuit has been exemplified in the above embodiment, the disclosure is not limited thereto and another circuit such as a digital locked loop (DLL) circuit may be mounted as a clock reproduction circuit.

In addition, while a case in which the white mark x is displayed on the black background as an abnormality notification screen has been exemplified in Embodiment 1, the disclosure is not limited thereto, and the display screen may be configured in white and black monochrome.

In addition, a case in which, among three regions of the display screen divided in the gate line direction, the red, green, and blue screens are displayed in order from the left has been exemplified in Embodiment 2, the order of RGB is not limited thereto. That is, it is sufficient for the first region for displaying red, the second region for displaying green, and the third region for displaying blue to be formed, and the order of arrangement in the display screens is not limited to that of the above embodiment. In addition, the areas of the regions may be different from each other. In addition, the abnormality notification screen may be composed using only two colors among RGB. For example, the first region and the third region may be displayed in red, and the second region may be displayed in blue. A configuration in which the display screen is divided into four or more regions to perform display may be used.

In addition, a case in which the output of the open drain terminal is used as the abnormal state sharing signal AS, when no communication abnormality is detected, the signal level is changed to the H level, and when a communication abnormality is detected, the signal level is changed to the L level has been exemplified in the above embodiment. However, the abnormal state sharing signal AS is not limited thereto, and each of the source drivers 14-1 to 14-*p* may be configured such that it can share the fact that an abnormality has been detected in communication with a communication controller 12 with other source drivers.

In addition, a case in which the display device 100 is a liquid crystal display device has been described in the above embodiment, but unlike this, an organic electro luminescence (EL) display device may be used.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display device, comprising:

a display panel including a plurality of data lines and a plurality of gate lines, and a plurality of pixel switches and a plurality of pixel units provided in a matrix at intersections of the plurality of data lines and the plurality of gate lines;

a display controller configured to output a video data signal;

a gate driver configured to supply a gate signal that controls the pixel switch to be on to the plurality of gate lines; and a plurality of source drivers arranged in an extension direction of the gate lines, each of which receives the video data signal from the display controller, and generate a gradation voltage signal to be supplied to each of the plurality of pixel units based on the video data signal, wherein each of the plurality of source drivers comprises:

a data processing unit configured to detect that an abnormality has occurred in communication with the display controller and share an abnormal state sharing signal indicating whether an abnormality has occurred in communication with the display controller in each of the plurality of source drivers with other source drivers, and when the abnormal state sharing signal indicates that an abnormality has occurred in communication with the display controller, each of the plurality of source drivers supplies a gradation voltage signal corresponding to predetermined gradation data different from a gradation voltage signal based on the video data signal to each of the plurality of pixel units.

2. The display device according to claim 1, wherein each of the plurality of source drivers comprises:

a latch circuit configured to capture pixel data pieces and sequentially output the pixel data pieces;

a gradation voltage converting unit configured to generate the gradation voltage signal based on the pixel data piece output from the latch circuit; and a source control unit configured to, when the abnormal state sharing signal indicates that no abnormality has occurred in communication with the display controller, supply a pixel data piece included in the video data signal to the latch circuit, and when the abnormal state sharing signal indicates that an abnormality has occurred in communication with the display controller, supply a pixel data piece corresponding to the predetermined gradation data to the latch circuit.

3. The display device according to claim 2, wherein each of the plurality of source drivers comprises:

a PLL circuit configured to generate a first clock signal based on the video data signal; and an oscillation circuit configured to generate a second clock signal that oscillates at a predetermined frequency, wherein the latch circuit is configured to, when the abnormal state sharing signal indicates that no abnormality has occurred in communication with the display controller, capture a pixel data piece based on the video data signal based on the first clock signal, and when the abnormal state sharing signal indicates that an abnormality has occurred in communication with the display controller, capture a pixel data piece corresponding to the predetermined gradation data based on the second clock signal.

4. The display device according to claim 3, wherein at least one source driver among the plurality of source drivers comprises a gate control unit configured to control supply of the gate signal by the gate driver, and wherein the gate control unit controls, when the abnormal state sharing signal indicates that no abnormality has occurred in communication with the display controller, a timing at which the gate signal is supplied by the gate driver based on the first clock signal, and when the abnormal state sharing signal indicates that an abnormality has occurred in communication with the display controller, the gate control unit controls a timing at which the gate signal is supplied by the gate driver based on the second clock signal.

5. The display device according to claim 1, wherein the predetermined gradation data is gradation data comprising a plurality of gradations that are different from each other, and wherein, when the abnormal state sharing signal indicates that an abnormality has occurred in communication with the display controller, the plurality of source drivers supply gradation voltage signals corresponding to the plurality of gradations to the plurality of pixel units and cause an abnormality notification screen to be displayed on the display panel.

6. The display device according to claim 1, wherein the plurality of pixel units are pixel units corresponding to respective R, G, and B pixels, and wherein, when the abnormal state sharing signal indicates that an abnormality has occurred in communication with the display controller, the plurality of source drivers supply a gradation voltage signal corresponding to the predetermined gradation data to a pixel unit corresponding to the R pixel positioned in a first region, a pixel unit corresponding to the G pixel positioned in a second region, and a pixel unit corresponding to the B pixel positioned in a third region among a plurality of regions obtained by dividing the display panel in an extension direction of the gate lines.

7. A source driver connected to a display panel comprising a plurality of data lines and a plurality of gate lines, and a plurality of pixel switches and a plurality of pixel units provided in a matrix at intersections of the plurality of data lines and the plurality of gate lines, wherein the source driver is used by being arranged in a plurality along an extension direction of the gate lines, receives a video data signal from a display controller, generates a gradation voltage signal based on the received video data signal, and supplies the gradation voltage signal to the plurality of pixel units, the source driver comprising:

a data processing unit configured to detect that an abnormality has occurred in communication with the display controller and share an abnormal state sharing signal indicating whether an abnormality has occurred in communication with the display controller with other source drivers, and when the abnormal state sharing signal indicates that an abnormality has occurred in communication with the display controller, the source driver supplies a gradation voltage signal corresponding to predetermined gradation data different from a gradation voltage signal based on the video data signal to each of the plurality of pixel units.

8. The source driver according to claim 7, comprising:

a latch circuit configured to capture pixel data pieces and sequentially output the pixel data pieces;

a gradation voltage converting unit configured to generate the gradation voltage signal based on the pixel data piece output from the latch circuit; and a source control unit configured to, when the abnormal state sharing signal indicates that no abnormality has occurred in communication with the display controller, supply a pixel data piece included in the video data signal to the latch circuit, and when the abnormal state sharing signal indicates that an abnormality has occurred in communication with the display controller, supply a pixel data piece corresponding to the predetermined gradation data to the latch circuit.

9. The source driver according to claim 8, comprising:

a PLL circuit configured to generate a first clock signal based on the video data signal; and an oscillation circuit configured to generate a second clock signal that oscillates at a predetermined frequency, wherein the latch circuit is configured to, when the abnormal state sharing signal indicates that no abnormality has occurred in communication with the display controller, capture a pixel data piece based on the video data signal based on the first clock signal, and when the abnormal state sharing signal indicates that an abnormality has occurred in communication with the display controller, capture a pixel data piece corresponding to the predetermined gradation data based on the second clock signal.

10. The source driver according to claim 9, comprising:

a gate control unit connected to a gate driver configured to supply a gate signal that controls the pixel switch to be on to the plurality of gate lines and the gate control unit controls supply of the gate signal by the gate driver, wherein, when the abnormal state sharing signal indicates that no abnormality has occurred in communication with the display controller, the gate control unit controls a timing at which the gate signal is supplied by the gate driver based on the first clock signal, and when the abnormal state sharing signal indicates that an abnormality has occurred in communication with the display controller, the gate control unit controls a timing at which the gate signal is supplied by the gate driver based on the second clock signal.

11. The source driver according to claim 7, wherein the predetermined gradation data is gradation data comprising a plurality of gradations that are different from each other, and wherein, when the abnormal state sharing signal indicates that an abnormality has occurred in communication with the display controller, the plurality of source drivers supply gradation voltage signals corresponding to the plurality of gradations to the plurality of pixel units and cause an abnormality notification screen to be displayed on the display panel.

12. The source driver according to claim 7, wherein the plurality of pixel units of the display panel are pixel units corresponding to respective R, G, and B pixels, and wherein, when the abnormal state sharing signal indicates that an abnormality has occurred in communication with the display controller, among a plurality of regions obtained by dividing the display panel in an extension direction of the gate lines, a gradation voltage signal corresponding to the predetermined gradation data is supplied to a pixel unit corresponding to the R pixel positioned in a first region, a pixel unit corresponding to the G pixel positioned in a second region, and a pixel unit corresponding to the B pixel positioned in a third region.

* * * * *